United States Patent [19]

Kamata et al.

[11] 4,126,071

[45] Nov. 21, 1978

[54] APPARATUS FOR AN AUTOMATIC MUSICAL PERFORMANCE

[75] Inventors: Kazuo Kamata, Hino; Yasushi Yamamoto, Okegawa, both of Japan

[73] Assignees: Kabushiki Kaisha Kawai Gakki Seisakusho, Hamamatsu; Sanyo Denki Kabushiki Kaisha, Moriguchi; Tokyo Sanyo Kabushiki Kaisha, Funma, all of Japan

[21] Appl. No.: 773,542

[22] Filed: Mar. 2, 1977

[30] Foreign Application Priority Data

Mar. 8, 1976 [JP] Japan ..... 51-24196
Mar. 9, 1976 [JP] Japan ..... 51-24621

[51] Int. Cl.[2] ..... G10H 1/00
[52] U.S. Cl. ..... 84/1.03; 84/DIG. 12
[58] Field of Search ..... 84/1.01, 1.03, 1.13, 84/1.17, 1.24, 1.26, DIG. 12, DIG. 22

[56] References Cited

U.S. PATENT DOCUMENTS

| | | | |
|---|---|---|---|
| 3,889,568 | 6/1975 | Amaya | 84/1.01 |
| 3,954,038 | 5/1976 | Adams | 84/1.01 |
| 3,986,424 | 10/1976 | Sakashita | 84/1.03 |
| 4,020,728 | 5/1977 | Robinson et al. | 84/1.03 |
| 4,054,078 | 10/1977 | Kondo | 84/1.24 |

*Primary Examiner*—Robert K. Schaefer
*Assistant Examiner*—Vit W. Miska
*Attorney, Agent, or Firm*—Haseltine, Lake, & Waters

[57] ABSTRACT

An arrangement for providing an automatic musical performance in which a digital signal indicating a root tone is obtained by depression of a key, and is added in sequential order with digital signals obtained from a memory circuit. The latter is driven by output pulses of a rhythm pulse generator. Binary coded signals from the outputs of the adder, open and close plural gate circuits interposed in plural tone source signal passing circuits. One decoder is provided at the plural output terminals of the adder, and plural output terminals of that decoder are connected to control terminals of respective gate circuits. The decoder converts the binary code signals into address signals. An additional decoder may be provided at the output of the adder for converting the output binary code signals to binary-coded duodecimal codes.

6 Claims, 5 Drawing Figures

OUT
INPT
9
18
19
14
12
21
22
21a
22a
23
13
11
11a
11b
11c
11d
11e
11f
11g
11h
6
A
B
C
D
E
C
C*
D
D*
E
F*
G
G*
A
A*
B

APPARATUS FOR AN AUTOMATIC MUSICAL PERFORMANCE

BACKGROUND OF THE INVENTION

In providing automatic musical performances, it is advantageous to apply electronic circuits that are substantially simple in design and construction so that they may be readily maintained in service and have a substantially long operating life. It is particularly advantageous to provide signal coding so that a minimum number of operating elements are required.

Accordingly, it is an object of the present invention to provide apparatus for an automatic musical performance which is simple in construction, and has the feature of an adder in which a digital signal indicating a root tone and obtained by depression of a key, is added in order or sequence with digital signals obtained from a memory circuit driven by output pulses of a rhythm pulse generator. Plural gate circuits are interposed in plural tone source signal passing circuits and are arranged to be opened and closed by binary code signals of the added outputs of the foregoing adder.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2:
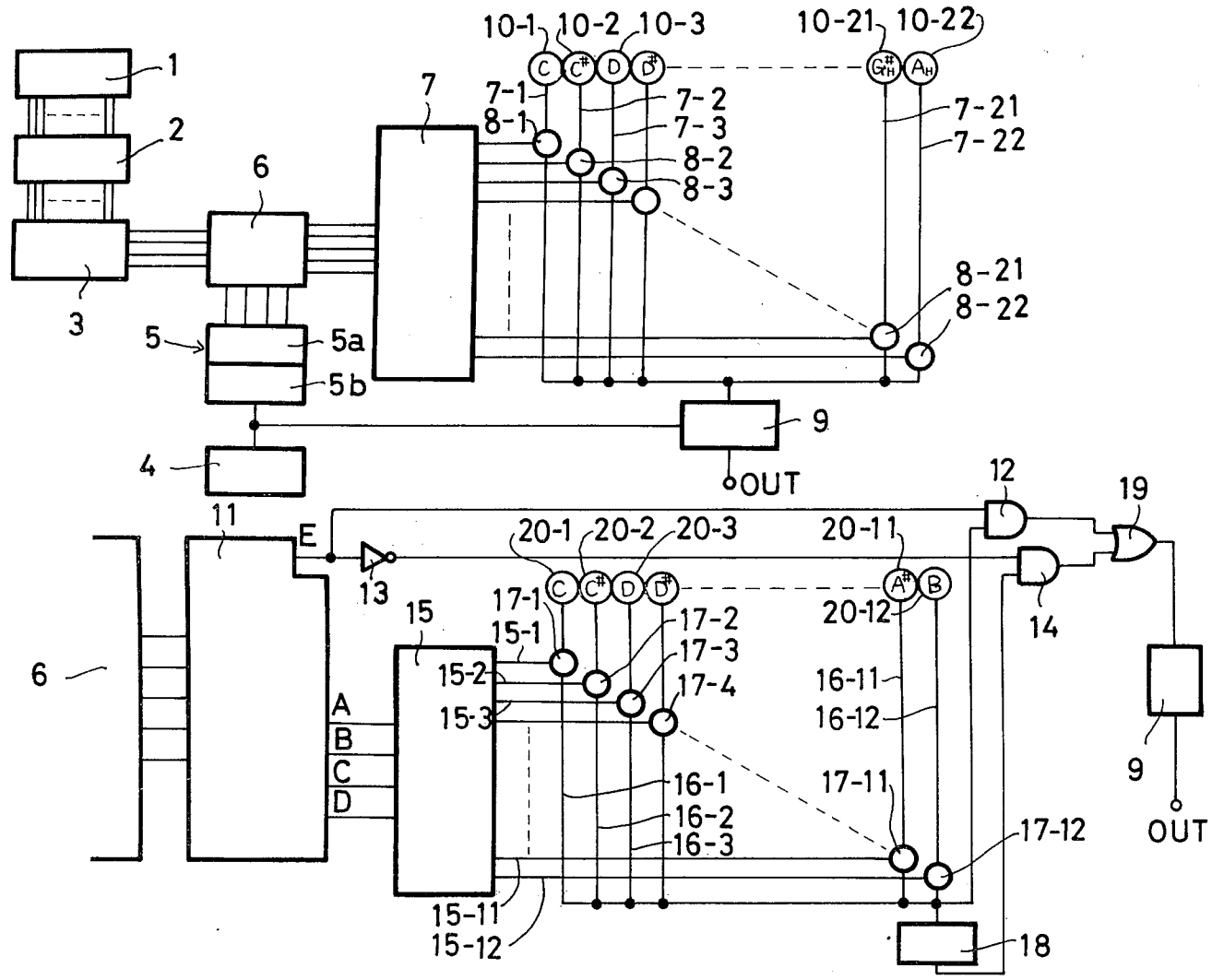
FIG. 1 is a block diagram and shows the essential components and their interrelationships of the presnt invention.
FIGS. 2 to 5 are block diagrams showing essential elements of additional embodiments of the present invention.

Referring to FIG. 1, reference numeral 1 denotes a key-switch circuit of a keyboard and numeral 2 denotes a detector for detecting a root tone from a key-switch closed, for instance, on depression of a key. Numeral 3 denotes an encoder for converting a root tone into a digital binary code signal. A relation between root tones and outputs of the encoder 3 is as shown in the following Table 1.

TABLE 1

| Root Tone | D | C | B | A |
|---|---|---|---|---|
| C | 0 | 0 | 0 | 0 |
| C# | 0 | 0 | 0 | 1 |
| D | 0 | 0 | 1 | 0 |
| D# | 0 | 0 | 1 | 1 |
| E | 0 | 1 | 0 | 0 |
| F | 0 | 1 | 0 | 1 |
| F# | 0 | 1 | 1 | 0 |
| G | 0 | 1 | 1 | 1 |
| G# | 1 | 0 | 0 | 0 |
| A | 1 | 0 | 0 | 1 |
| A# | 1 | 0 | 1 | 0 |
| B | 1 | 0 | 1 | 1 |

Numeral 4 denotes a rhythm pulse generator for generating rhythm pulses according to a rhythm of the music, and numeral 5 denotes a memory cicuit driven by output pulses of the rhythm pulse generator 4. The memory circuit 5 comprises, for instance, a matrix circuit 5*a* and a timing pulse generator 5*b* such as a ring counter or the like for selecting in order plural addresses of the matrix circuit 5*a*, and thus the respective addresses are selected in order by the timing pulses generated from the timing pulse generator 5*b*.

The matrix circuit 5*a* may be comprised, for instance, of a read-only memory and the same comprises 8 words −4 bits, for instance, as shown in the following Table 2. The respective addresses are so set by digital binary codes as to have respectively 1°, 3°, 5°, 6°, 7°, 5° and 3° in relation to the root tone.

TABLE 2

| Address | D C B A | Degree relationship |
|---|---|---|
| 1 | 0 0 0 0 | 1 degree |
| 2 | 0 1 0 0 | 3 degrees |
| 3 | 0 1 1 1 | 5 degrees |
| 4 | 1 0 0 1 | 6 degrees |
| 5 | 1 0 1 0 | 7 degrees |
| 6 | 1 0 0 1 | 6 degrees |
| 7 | 0 1 1 1 | 5 degrees |
| 8 | 0 1 0 0 | 3 degrees |

Numeral 6 denotes an adder comprising a ful adder for adding an output of the encoder 3 and an output of the read-only memory 5*a*.

If, now, a key for a C chord in the keyboard is depressed and the root tone C is detected at the detector 2 and "0 0 0 0" as shown in the Table 1 is taken out from the decoder 3, outputs of the adder 6 become as shown in the following Table 3.

TABLE 3

| Root Tone | Output of Matrix Circuit | Output of Adder | Tone Name of Output | In relation to C tone |
|---|---|---|---|---|
| 0 0 0 0 | 0 0 0 0 | 0 0 0 0 0 | C | 1 degree |
| " | 0 1 0 0 | 0 0 1 0 0 | E | 3 degrees |
| " | 0 1 1 1 | 0 0 1 1 1 | G | 5 degrees |
| " | 1 0 0 1 | 0 1 0 0 1 | A | 6 degrees |
| 0 0 0 0 | 1 0 1 0 | 0 1 0 1 0 | A# | 7 degrees |
| " | 1 0 0 1 | 0 1 0 0 1 | A | 6 degrees |
| " | 0 1 1 1 | 0 0 1 1 1 | G | 5 degrees |
| " | 0 1 0 0 | 0 0 1 0 0 | E | 3 degrees |

If in the keyboard a key for a F chord is depressed and th root tone F is detected at the detector 2, outputs of the adder 6 become as shown in the following Table 4.

TABLE 4

| Root Tone | Output of Matrix Circuit | Output of Adder | Tone Name of Output | In relation to F tone |
|---|---|---|---|---|
| 0 1 0 1 | 0 0 0 0 | 0 0 1 0 1 | F | 1 degree |
| " | 0 1 0 0 | 0 0 1 0 0 | A | 3 degrees |
| " | 0 1 1 1 | 0 1 1 0 0 | $C_H$ | 5 degrees |
| " | 1 0 0 1 | 0 1 1 1 0 | $D_H$ | 6 degrees |
| 0 1 0 1 | 1 0 1 0 | 0 1 1 1 1 | $D^{\#}_H$ | 7 degrees |
| " | 1 0 0 1 | 0 1 1 1 0 | $D_H$ | 6 degrees |
| " | 0 1 1 1 | 0 1 1 0 0 | $C_H$ | 5 degrees |
| " | 0 1 0 0 | 0 1 0 0 1 | A | 3 degrees |

Numeral 7 denotes a first decoder for converting the outputs of the adder 6 into address signals, and the same has 22 output terminals connected to respective gate circuits 8-1 . . . 8-22 interposed in plural tone source signal passing circuits 7-1, 7-2 . . . 7-22. Numeral 9 denotes an envelope circuit connected in common to the tone source signal passing circuits 7-1 . . . 7-22, and the envelope circuit 9 is so controlled by output pulses of the rhythm pulse generator 4, that the tone source signals passing therethrough may be given an envelope set therein. Numerals 10-1 . . . 10-22 denote tone source signal oscillators.

If, thus, as mentioned above, the key for the C chord in the keyboard is depressed and pulses according to a given rhythm are obtained at the output terminal of the rhythm pulse generator 4, outputs of the adder 6 are as shown in the foregoing Table 3. The digital binary code signals are converted into address signals by the decoder 7 and the gate circuits 8-1, 8-5, 8-8, 8-10, 8-11, 8-10, 8-8, 8-5 for C tone, E tone, G tone, A tone, A♯ tone, A tone, G tone and E tone are opened in sequential order, and tones of C, E, G, A, A♯, A, G, E are obtained in order according to the rhythm pulses. This is then repeated.

Similarly, if the key for the F chord is depressed, the gate circuits for F tone, A tone, $C_H$ tone, $D_H$ tone, $D\#_H$ tone, $D_H$ tone, $C_H$ tone and A tone are opened in sequential order, whereby tones of F, A, $G_H$, $D\#_H$, $D_H$, $C_H$, A are obtained in order, and this is repeated.

Such a modification may be considered in terms that in the memory circuit 5, the timing pulse generator **5*b* is omitted and the binary codes having any desired proper degree relation to the root tone, are set by the matrix circuit 5*a*** alone.

In the first embodying example as described above, if 12 tones are used as root tones and a broken chord including up to 7° is to be formed, 22 tone sources and 22 gate circuits for opening and closing them are required as shown in FIG. 1.

FIG. 2 shows another embodying example wherein the tone sources and the gate circuits are decreased in number, and yet, thereby, a broken chord including relationship of 7° or more can be obtained, with 12 tones being used as root tones. The adder 6 is provided on its output side with a second decoder 11 which converts the binary codes into binary-coded duodecimal codes, and an output terminal E thereof indicating "13" is connected to a control electrode of a first gate 12 and through a NOT circuit 13 to a control electrode of a second gate 14. The remainder four output terminals thereof A, B, C, D indicate as far as 12 by binary codes and are connected to a third decoder 15 for converting into address signals. Twelve output terminals 15-1 . . . 15-12 of the third decoder 15 are connected to control electrodes of gate circuits 17-1 . . . 17-12 interposed in 12 tone source signal passing circuits 16-1 . . . 16-12. These tone source signal passing circuits 16-1 . . . 16-12 are connected together on the output sides of the gate circuits 17-1 . . . 17-12 so that they are connected to an input terminal of the foregoing first gate 12, and are also connected through a frequency divider 18 having a frequency dividing ratio of 2, to an input terminal of the second gate 14. Output terminals of these first and second gates 12, 14 are connected to the envelope circuit 9 through an OR circuit 19. Numerals 20-1 . . . 20-12 denote tone source signal generators.

The true values of the foregoing decoder 11 are as shown in the following Table 5.

TABLE 5

| | INPUT | | OUTPUT |
|---|---|---|---|
| | E D C B A | | E D C B A |
| 1 | 0 0 0 0 0 | $C_L$ | 0 0 0 0 0 |
| 2 | 0 0 0 0 1 | $C\#_L$ | 0 0 0 0 1 |
| 3 | 0 0 0 1 0 | $D_L$ | 0 0 0 1 0 |
| 4 | 0 0 0 1 1 | $D\#_L$ | 0 0 0 1 1 |
| 5 | 0 0 1 0 0 | $E_L$ 00100 | |
| 6 | 0 0 1 0 1 | $F_L$ | 0 0 1 0 1 |
| 7 | 0 0 1 1 0 | $F\#_L$ | 0 0 1 1 0 |
| 8 | 0 0 1 1 1 | $G_L$ | 0 0 1 1 1 |
| 9 | 0 1 0 0 0 | $G\#_L$ | 0 1 0 0 0 |
| 10 | 0 1 0 0 1 | $A_L$ | 0 1 0 0 1 |
| 11 | 0 1 0 1 0 | $A\#_L$ | 0 1 0 1 0 |

TABLE 5-continued

| | INPUT | | OUTPUT |
|---|---|---|---|
| | E D C B A | | E D C B A |
| 12 | 0 1 0 1 1 | $B_L$ | 0 1 0 1 1 |
| 13 | 0 1 1 0 0 | C | 1 0 0 0 0 |
| 14 | 0 1 1 0 1 | C# | 1 0 0 0 1 |
| 15 | 0 1 1 1 0 | D | 1 0 0 1 0 |
| 16 | 0 1 1 1 1 | D# | 1 0 0 1 1 |
| 17 | 1 0 0 0 0 | E | 1 0 1 0 0 |
| 18 | 1 0 0 0 1 | F | 1 0 1 0 1 |
| 19 | 1 0 0 1 0 | F# | 1 0 1 1 0 |
| 20 | 1 0 0 1 1 | G | 1 0 1 1 1 |
| 21 | 1 0 1 0 0 | G# | 1 1 0 0 0 |
| 22 | 1 0 1 0 1 | A | 1 1 0 0 1 |

When the decoder 11 has applied to it the binary code signals up to 12, the terminal E is "0" at its output, so that the gate 12 is non-conductive. In the meantime, second gate 14 is conductive because the same is applied with "1" through the NOT circuit 13. Thus, frequencies of the tone source signals passing through the gate circuits 17-1 . . . 17-12 are divided into ½ by the frequency divider 18, and thereafter they are passed through the second gate 14.

When the decoder 14 has applied to it binary code signals of from 13 to 22, the terminal E is "1" in its output, so that the first gate 12 becomes conductive and the second gate 14 becomes non-conductive.

Thus, the tone source signals passing through the gate circuits 17-1 . . . 17-12 are directly passed through the first gate 12, without passing through the frequency-divider 18.

Figure 3:
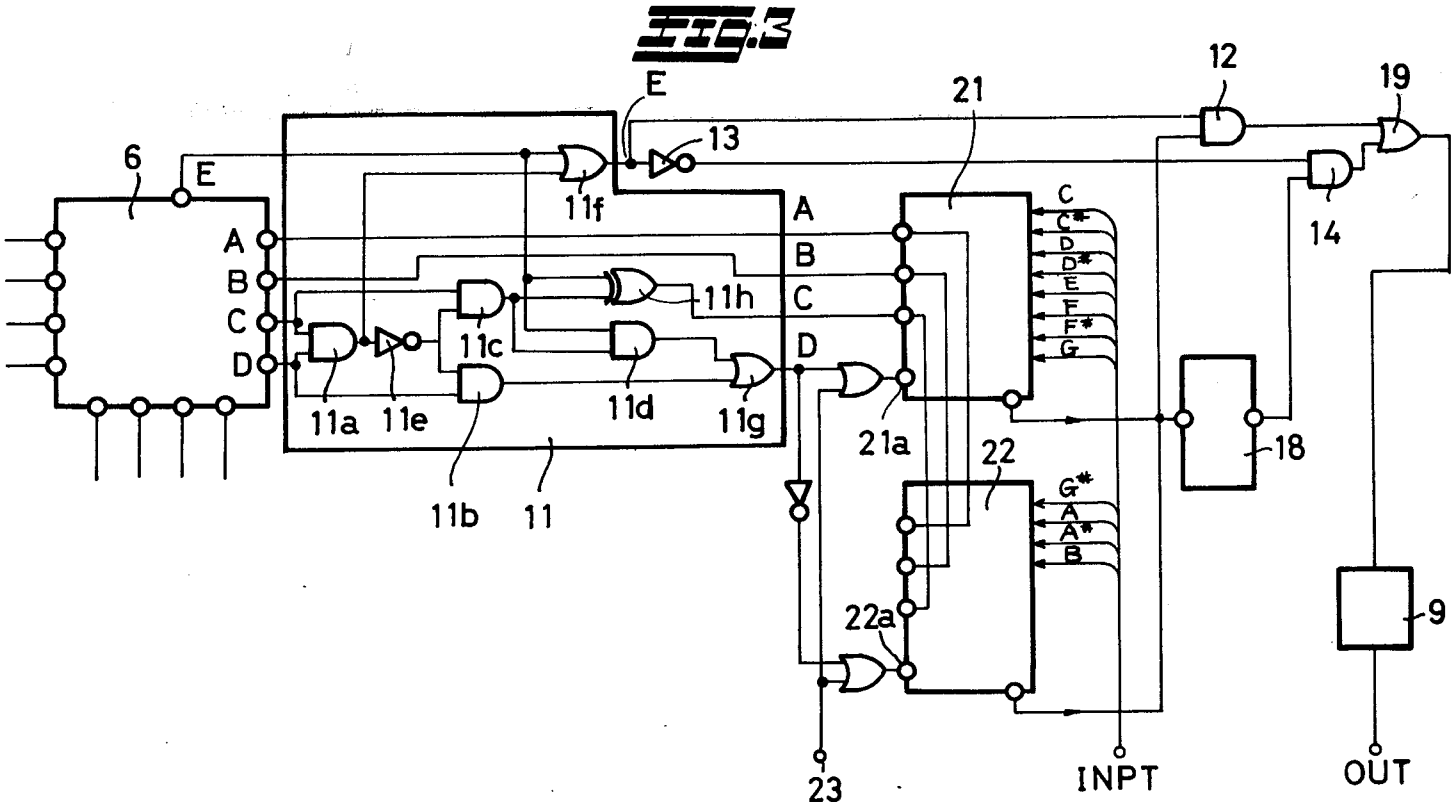

FIG. 3 shows another embodying example wherein the decoder 15 and the gate circuits 17-1 . . . 17-12 are replaced by two multiplexers 21, 22. These multiplexers 21, 22 are so constructed that two of F4051 (Fairchild) with 8 signal channels are provided in parallel with each other, and are so arranged that one 21 of the two is used for up to 8 and the other 22 is used for up to 12, with more than 9 being carried. Numeral 23 denotes a terminal connected in common to inhibit terminals **21*a*, 22*a* of the multiplexers 21, 22**, and it is so arranged that L is given thereto when the key on the keyboard is ON and H is given thereto when the key is OFF. Thus, the signal "L" is generated when the key is depressed and the signal "H" is generated when the key is not depressed. Means for generating these signals "L", "H" will be clear from "Key Down Detector" as disclosed in U.S. Pat. No. 3,954,038, and U.S. Pat. No. 4,020,728 for example.

In FIG. 3, the second decoder 11 is shown in a circuit, wherein numerals **11*a*, 11*b*, 11*c*, 11*d* are AND gates, 11*e* is a NOT circuit, 11*f*, 11*g* are OR gates and 11*h*** is an Exclusive OR circuit.

In all the automatic musical performance apparatus as set forth so far, a broken chord in minor cannot be obtained unless the matrix circuit **5*a* of the memory circuit 5** is re-set or replaced.

Figure 4:
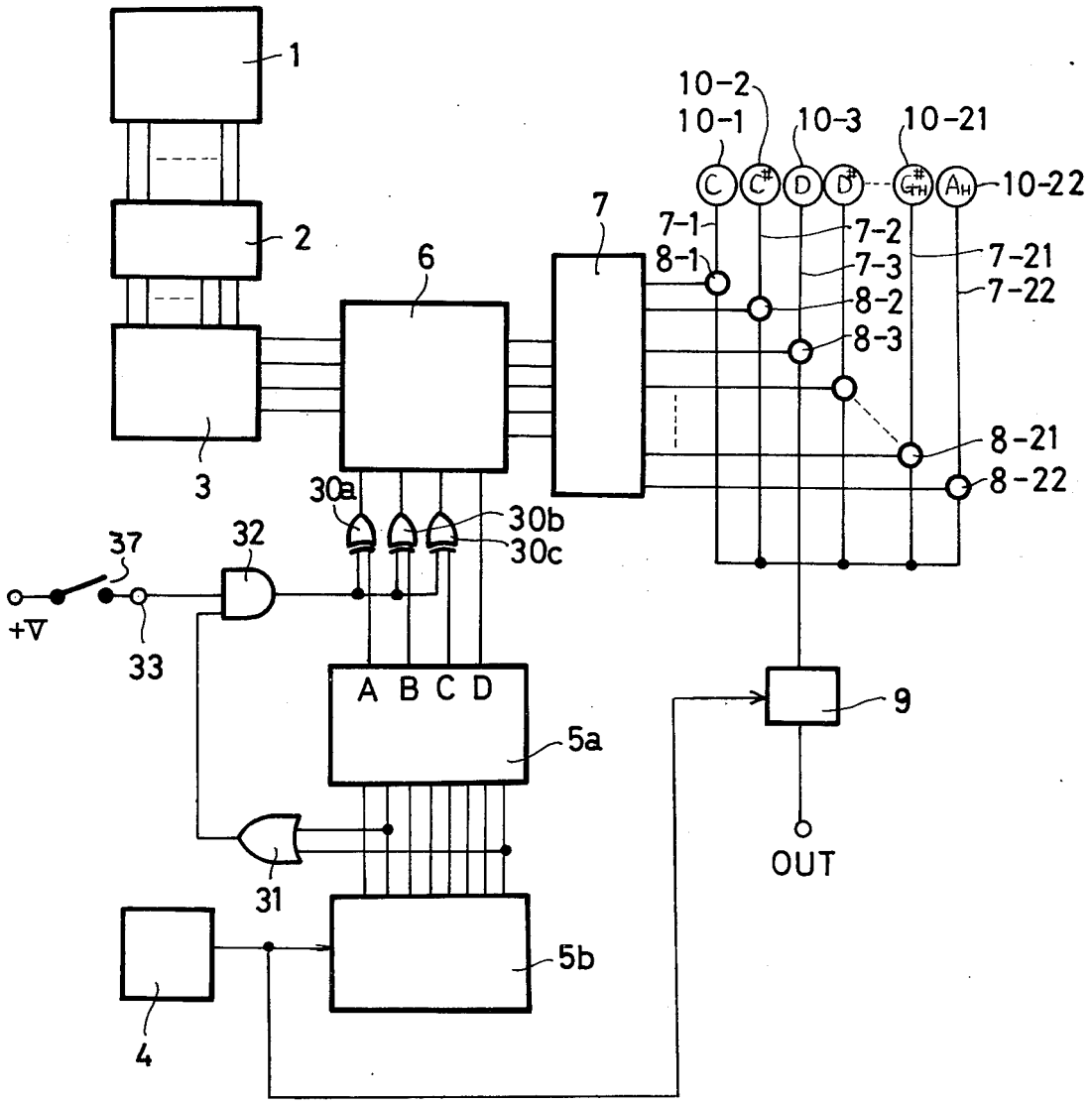

In an embodying example as shown in FIG. 4, a performance of a broken chord in minor can be obtained by simply changing a signal of major 3rd to a signal of minor 3rd. Thus, three terminals A, B, C among four terminals A, B, C, D of the matrix circuit **5*a* are provided with respective signal converters 30*a*, 30*b*, 30*c* connected thereto. These signal converters 30*a*, 30*b*, 30*c* each is composed of an non-coincidence circuit. The 2nd and the 8th output terminals of the timing pulse generator 5*b* are connected to an AND gate 31, and an output terminal thereof is connected to control terminals, that is, other input terminals of the foregoing non-coincidence circuits 30***a*, 30*b*, 30*c* through a switch element 32. The switch element 32 comprises an AND gate, and the other input terminal 33 is connected through a switch 37 to an electric sorce +V. The 2nd and the 8th output terminals are the terminals for selecting the 2nd and 8th addresses. Each memorizes the minor 3rd "0100" of the matrix circuit 5*a* as is clear from the Table 2.

If, under the condition that the switch 37 is closed and H is given to the input terminal 33, a second pulse is generated at the 2nd output terminal of the timing pulse generator 5*b*, the 2nd address of the matrix circuit 5*a* is selected and "0100" is taken out. The 2nd pulse is applied to the non-coincidence circuits 30*a*, 30*b*, 30*c* through the switch element 32, whereby "0100" is converted into "0011". This is a minor 3rd in relation to the root tone. Similarly, "0011" may be obtained also by the 8th pulse. Thus, the signals applied to the adder 6 are as shown in the following Table 6.

TABLE 6

| D C B A | Degree relation |
|---|---|
| 0 0 0 0 | 1 degree |
| 0 0 1 1 | minor 3 degrees |
| 0 1 1 1 | 5 degrees |
| 1 0 0 1 | 6 degrees |
| 1 0 1 0 | 7 degrees |
| 1 0 0 1 | 6 degrees |
| 0 1 1 1 | 5 degrees |
| 0 0 1 1 | minor 3 degrees |

When the switch 37 is not closed and the switch element 32 is kept in its OFF condition, output signals of the memory circuit 6 are not changed, and thus the major signals are applied to the adder 6 as mentioned before.

The above arrangement is of the type that it is changed over from major to minor only when the switch element 37 is handled, and it is inconvenient in that a high technique is required where such handling is carried out in the midst of a performance. For avoiding such a handling, the following construction is applicable.

Figure 5:
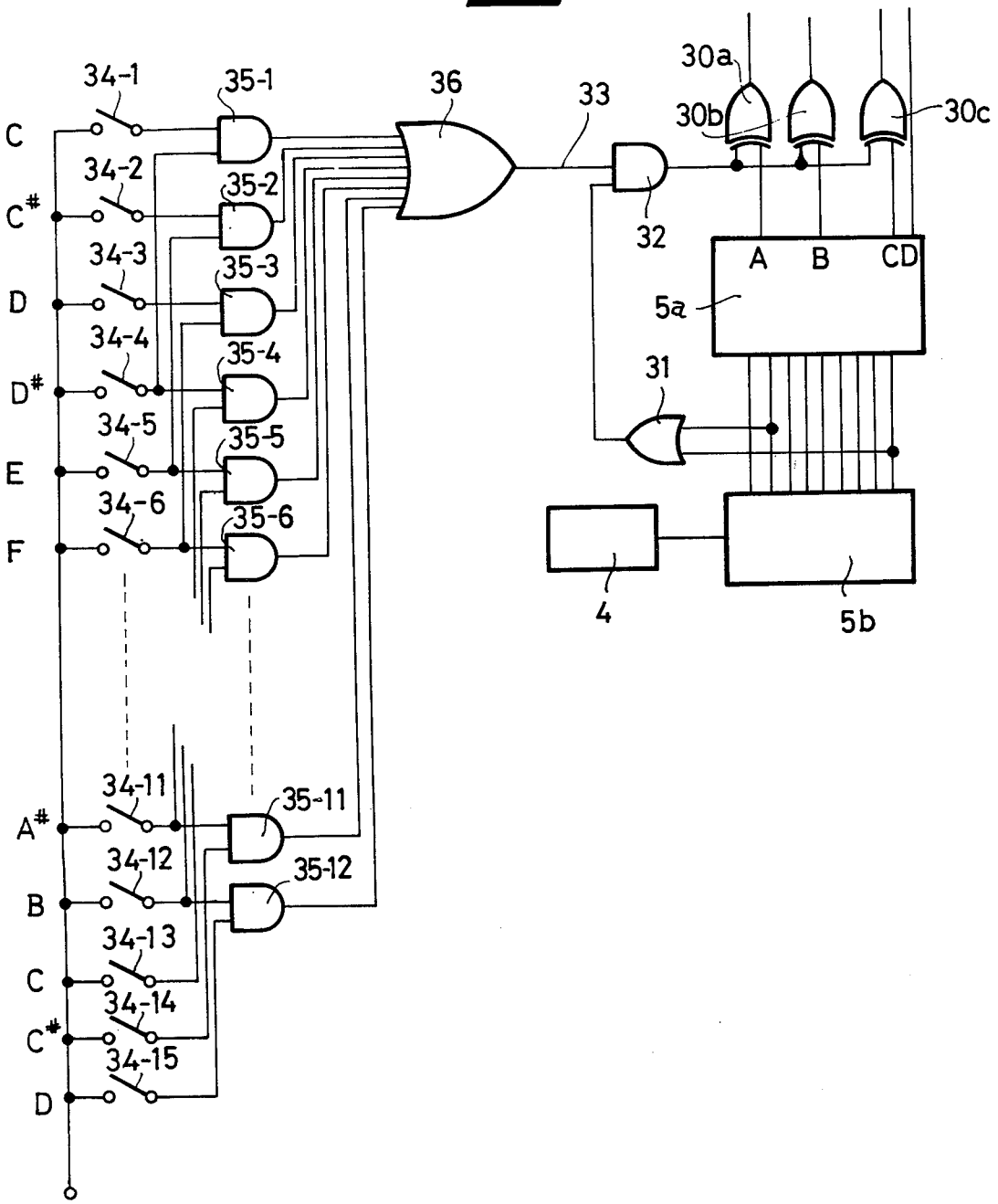

As shown in FIG. 5, (a further embodiment of the arrangement of FIG. 4) key-switches 34-1 . . . 34-12 for root tones in the key-switch circuit 1 of the keyboard and key-switches 34-4 . . . 34-15 each having a relation of minor 3rd in relation to those key-switches 34-1 . . . 34-12, are connected respectively to AND gates 35-1 . . . 35-12. Output terminals of these AND gates 35-1 . . . 35-12 are connected through an OR circuit 36 to an input terminal 33 of an AND circuit constituting the foregoing switch element 32.

What is claimed is:

1. Apparatus for an automatic musical performance comprising: adder means having binary-coded signal outputs representing added amounts; means for obtaining a digital signal indicating a root tone by depression of a key; a memory circuit providing digital signals; said first-mentioned digital signal being added by said adder means in sequential order with said digital signals from said memory circuit; a rhythm pulse generator with output pulses for driving said memory circuit; plural tone source signal passing circuits; plural gate circuits interposed in said plural tone source signal passing circuits; said plural gate circuits being opened and closed by said binary coded signals from said outputs of said adder means.

2. Apparatus for an automatic musical performance as defined in claim 1 including first decoder means connected to the plural outputs of said adder means for converting said binary coded signals into address signals; said decoder having plural output terminals connected to respective ones of said gate circuits.

3. Apparatus for an automatic musical performance as defined in claim 1 including a first decoder connected to the output of said adder means for converting said binary coded signals into binary-coded duodecimal codes; said first decoder having an output terminal indicating when at least 13 is connected to a control electrode of a first one of said gates; a NOT circuit connected between said output terminal of said first decoder and a second one of said gates; a second decoder connected to the remaining plural output terminals indicating up to 12 of said first decoder for converting into address signals; said second decoder having 12 output terminals connected to respective ones of said gate circuits interposed in 12 tone source signal passing circuits; a frequency divider; said tone source signal passing circuits being connected together at their output side of the respective gate circuits and being connected to an input terminal of said first gate and also through said frequency divider to an input terminal of said second gate.

4. Apparatus for an automatic musical performance as defined in claim 3 including multiplexer means holding said second decoder and 12 gate circuits interposed in 12 tone source signal passing circuits.

5. Apparatus for an automatic musical performance as defined in claim 1 including a matrix circuit comprising a read-only memory; said memory circuit comprising a timing pulse generator for generating pulses in sequential order at plural output terminals of said memory circuit by output pulses from said rhythm pulse generator; signal convertors connected to selected ones of plural output terminals of said matrix circuit; switching means; selected ones of plural output terminals of said timing pulse generator being connected to said signal converters through said switching means.

6. Apparatus for an automatic musical performance as defined in claim 5 including key-switches for respective root tones; key-switches for respective tones of minor third in relation to the root tones; AND gate circuits connected to respective ones of said key switches and having output terminals connected to said switching means.

* * * * *

UNITED STATES PATENT AND TRADEMARK OFFICE

CERTIFICATE OF CORRECTION

PATENT NO. : : 4,126,071

DATED : November 21, 1978

INVENTOR(S) : KAZUO KAMATA and YASUSHI YAMAMOTO

It is certified that error appears in the above-identified patent and that said Letters Patent are hereby corrected as shown below:

Change the name of the Assignee
"Tokyo Sanyo Kabushiki Kaisha" to read
--Tokyo Sanyo Denki Kabushiki Kaisha--.

Signed and Sealed this

*Twentieth* Day of *May 1980*

[SEAL]

*Attest:*

SIDNEY A. DIAMOND

*Attesting Officer*

*Commissioner of Patents and Trademarks*